United States Patent [19]

Buel

[11] 4,116,462

[45] Sep. 26, 1978

[54] HEEL BINDING FOR TRAIL SKIS

[76] Inventor: G. Theodore Buel, 1179a King St., W., Toronto, Canada, M6K 3C5

[21] Appl. No.: 783,334

[22] Filed: Mar. 31, 1977

[30] Foreign Application Priority Data

Apr. 27, 1976 [CA] Canada ..... 251177

[51] Int. Cl.[2] ..... A63C 9/12

[52] U.S. Cl. ..... 280/614; 280/619; 280/636

[58] Field of Search ..... 280/614, 615, 636, 611, 280/619

[56] References Cited

U.S. PATENT DOCUMENTS

| | | | |
|---|---|---|---|
| 2,158,599 | 5/1939 | Weber | 280/614 |
| 2,554,706 | 5/1951 | Johansen | 280/619 |
| 3,870,325 | 3/1975 | Davis | 280/611 |
| 3,985,371 | 10/1976 | Pyzel et al. | 280/614 |

FOREIGN PATENT DOCUMENTS

| | | | |
|---|---|---|---|
| 138,926 | 4/1934 | Austria | 280/619 |
| 350,596 | 7/1937 | Italy | 280/611 |
| 10,056 | 2/1901 | Norway | 280/619 |
| 316,787 | 10/1956 | Switzerland | 280/614 |

*Primary Examiner*—David M. Mitchell
*Attorney, Agent, or Firm*—Emory L. Groff, Jr.

[57] ABSTRACT

The present invention relates to a heel binding for use with a toe binding on a trail ski which heel binding comprises in combination an elongated elastic member suitably made of gum rubber adapted to be attached at each end thereof to a ski boot to form a closed loop suitably by means of a plate member formed of leather; a heel locating member fixedly attachable to the ski adjacent the heel of said ski boot, adapted to cooperate with a notch in the heel of said ski boot to locate said boot on said ski and a latch fixably attachable to said ski adapted to releasably receive said elongated member so as to maintain said elongated member under sufficient tension to resiliently retain the heel of the ski boot in contact with the ski.

7 Claims, 4 Drawing Figures

HEEL BINDING FOR TRAIL SKIS

The present invention relates to cross country, i.e. trail skiing. In particular, the present invention relates to a heel binding for use with trail skis.

In alpine skiing the ski bindings together with the steel edges on the skis must always provide the skier with the capability of excellent control over both his speed and direction. Such ski bindings thus consist of a toe binding and a heel binding which in combined action during the alpine skiing ensure that the boot is clamped firmly and tightly to the ski at all times. For safety, release of either the heel or toe binding causes complete release of the ski from the boot. Heel bindings for use in alpine skiing over the years have assumed very sophisticated mechanisms to achieve optimum effect.

In trail skiing the ski boot which is usually a soft leather boot is held on the ski only by a toe binding such that the heel of the boot may be lifted vertically from the ski generally pivoting about the fixed toe portion of the boot. The facility to raise the heel of the boot from the ski aids the skier both on the level portions and uphill portions of the trail. However, on downhill portions of the trail, the trail skier has very little control over his speed and minimal control over his direction and must in general travel in a straight path down the slope relying on the subsequent portions of the trail to reduce his speed which was picked up on the slope. Thus, the trail ski is normally only provided from that portion adjacent the heel of the ski boot with an upstanding serrated portion upon which the heel of the boot rests, this serving only to hold the boot on the ski under normal conditions. The normal techniques of control of speed and direction open to an alpine skier including snowplough, stem-christie and christie turns, are not readily available to the trail skier going down an incline as any significant pressure applied by the skier to his boot transverse to the length of the ski causes the boot to slide sideways off the ski.

The present invention provides a heel binding for use in combination with the conventional toe binding on a trail ski which is inexpensive to make, simple in construction and may be quickly and easily operated by the trail skier just before skiing down a slope to resiliently hold the heel of his boot in position in contact with the ski with sufficient force to allow him to generally apply alpine ski techniques with speed and direction control during his passage down the slope, which binding may be quickly and easily released by the trail skier after passing down the slope to allow him to regain a loose heel for subsequent trail skiing on level or upward portions of the trail.

Thus, the present invention provides a heel binding which in combination with the conventional toe binding on a trail ski provides the trail skier generally with the advantages of control which an alpine skier has when passing down a slope on the trail.

According to the present invention there is provided a heel binding for use with a toe binding on a trail ski which heel binding comprises in combination an elongated elastic member adapted to be attached at each end thereof to a ski boot to form a closed loop, means, fixedly attachable to the ski adjacent the heel of said ski boot, adapted to cooperate with means on said ski boot to locate said boot on said ski and latch means fixedly attachable to said ski, adapted to releasably receive said elongated member so as to maintain said elongated member under sufficient tension to resiliently retain the heel of the ski boot in contact with the ski.

The present invention also provides in a trail ski having a toe binding adapted to releasably attach the toe of a ski boot from said ski, a heel binding for releasably attaching the heel of said ski boot to said ski, said heel binding comprising means fixedly attached to said ski adjacent said heel of said boot and adapted to cooperate with means on said boot to locate this boot on said ski, an elongated elastic member adapted to be attached at each end thereof to said ski boot to form a closed loop and means fixedly attached to said ski adapted to releasably receive said elongated member so as to maintain said elongated member under a tension sufficient to resiliently retain the heel of the ski boot in contact with the ski.

In a particular embodiment of the present invention the means for locating the heel of the boot on the ski comprises a member suitably made of a plastics material such as nylon, having a shaped front end, suitably a wedge shaped front end, which cooperates with a similarly shaped notch in the heel of the ski boot. Desirably the means for retaining the elongated member under tension is a hook member, suitably made of a plastic such as nylon, which is fixedly mounted on said ski behind the shaped member. In a particularly advantageous embodiment of the present invention the two members are unitary.

Thus, the present invention also provides a member for use in combination with an elongated elastic member attachable to a trail ski boot to form a closed loop to form a heel binding on a trail ski, said member having a hook extending from one end thereof to receive said elastic member and maintain it under tension and a shaped end at the other end thereof, suitably a V-shaped end, adapted to cooperate with a similarly shaped notch in the heel of the ski boot for location of the ski boot on the ski.

The elongated elastic member is desirably made of gum rubber and is attachable to the ski boot to form a closed loop. Suitably, the ends of the elongated member are joined by means of a plate member having hole therein for the passage of the laces of the ski boot therethrough for attachment of the elongated member to the ski boot. The plate member may be rigid or flexible and may suitably be made of a flexible sheet material such as leather or a plastics material.

The present invention will be further illustrated by way of the accompanying drawings in which.

Figure 1:
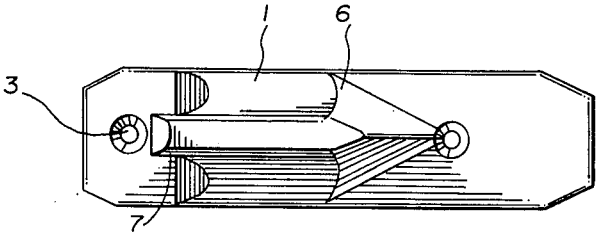
FIG. 1 is a plan view of a heel locating member of a heel binding according to one embodiment of the present invention.
Figure 2:
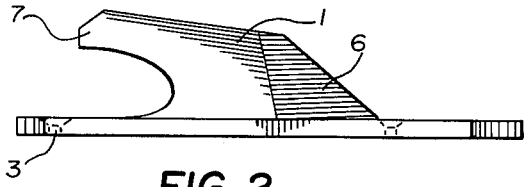
FIG. 2 is a side view of the member of FIG. 1.
Figure 3:
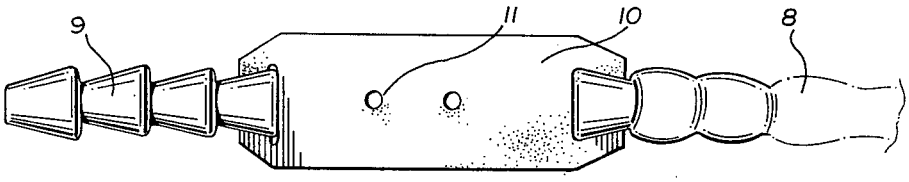
FIG. 3 is a plan view of an elongated elastic member of the heel binding of FIG. 1.
Figure 4:
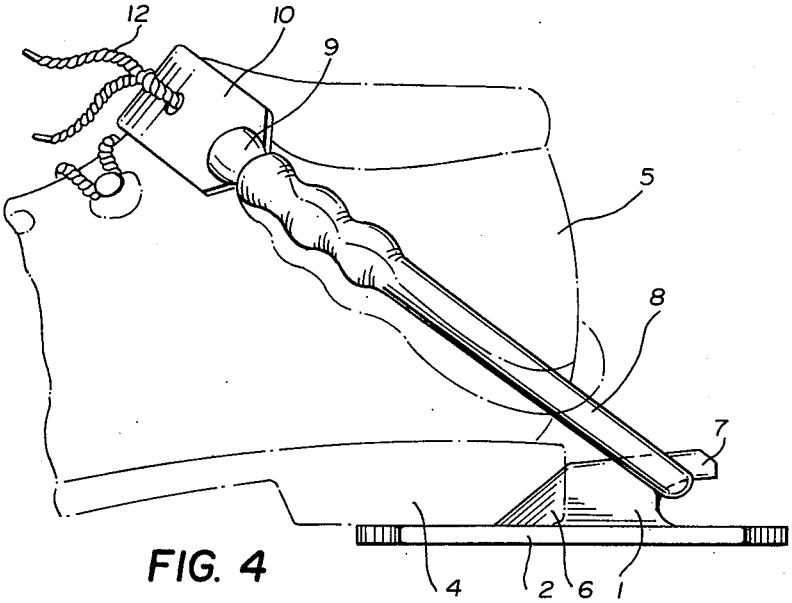
FIG. 4 is a partial side elevation of the heel of the ski boot attached to a trail ski by means of the heel binding of FIGS. 1 to 3.

Referring to the accompanying drawings, the heel binding comprises a flat heel locating base member 1 fabricated of a plastic material such as nylon which is attached to the trail ski 2 by means of screws through holes 3. The member 1 is aligned with the position of the heel 4 of the boot 5 on the ski by a toe binding (not shown). The member 1 has a wedge-shaped front portion 6 which fits snugly into a similar shaped notch in the heel 4 of the boot 5. Thus, the heel locating member 1 serves to guide the boot 5 down to the centre of the ski 2 during up and down motion and facilitates a lateral force transfer to the ski 2 from the leg of the skier. This allows the skier to move the ski 2 from side to side and to accomplish the skiing techniques associated with alpine skiing known as setting the edges.

The member 1 has a rear hook 7 for receiving an elongated elastic member 8 which is a gum rubber hollow tubular member, for holding the ski 2 in firm contact with the boot 5 and thus allow the skier to control the movement of the back portion of the ski 2. When the heel locating member is thus used with toe restraining binding and with the elastic member 8 in place the ski 2 is firmly held in contact with the foot longitudinally i.e. forward and backward, vertically, i.e. upwardly and downwardly, and laterally, i.e. side to side. This allows the skier to use the skis in additional ways be executing a range of movements not otherwise possible with normal cross country ski bindings.

The ends of the elastic member 8 are fixedly attached by means of plastic pegs 9 to a leather piece 10 to form a closed loop. The pegs 9 being inserted in the ends of the hollow tubular member 8. The leather piece 10 has a pair of holes 11 for the accommodation of the laces 12 of the boot 5 so that the closed loop is firmly attached to the boot 5. The elasticity of the member 8 allows movement of the foot and leg of the skier against the resistance of the member 8 which ensures the safety in a fall to the same extent as the presence solely of the toe binding. The elasticity of the member 8 allows the member 8 to return to its original length so that when not in use it assumes a position wrapped around the ankle of the skier and also of the boot 5 without interference with the normal movement of the boot 5 and the ski 2 during flat cross country skiing. On reaching a downward slope it is a simple matter for the skier to reach down and stretch the member 8 to hook over the hook 7 on each ski 2 and thus provide for controlled skiing down the slope. At the bottom of the slope or as desired the elastic member 8 can quickly and readily be unhooked from the heel locating member 1.

I claim:

1. In a trail ski including a toe binding, a heel binding for use in combination with a ski boot, said heel binding comprising an elongated elastic member attached at each end thereof to said ski boot to form a closed loop, heel locating means including a flat base attached to the upper surface of the ski adjacent the heel of said ski boot, a shaped portion extending from one end of said base and a hook extending from the other end of said base, said shaped portion and hook being integral and forming a single member perpendicular to said base and integral therewith, a notch in said ski boot heel cooperating with said shaped portion to locate said boot on said ski in alignment with said toe binding, said hook releasably receiving said elastic member so as to maintain said elastic member under sufficient tension to resiliently retain the heel of the ski boot in contact with the ski.

2. A binding as claimed in claim 1 in which the member is formed of a plastics material.

3. A binding as claimed in claim 2 in which the elongated member has the ends thereof joined by a plate member having holes therein through which laces of the ski boot may be threaded for attachment to the ski boot whereby to form the closed loop.

4. A binding as claimed in claim 3 in which the plate member is made of leather.

5. A binding as claimed in claim 4 in which the elongated member is made of gum rubber.

6. A member for use in combination with a trail ski boot and an elongated elastic member attachable to said trail ski boot to form a closed loop, and thus form a heel binding on a trail ski, said member including oppositely disposed ends and having a hook extending vertically outwardly from one end thereof to receive said elastic member and maintain it under tension and a vertically disposed shaped end at the other end thereof cooperating with a similarly shaped notch in the heel of the boot for location of the boot on the ski.

7. A member as claimed in claim 6 in which the shaped end is a V-shaped end.

* * * * *